US005286310A

United States Patent [19]

Carinci et al.

[11] Patent Number: 5,286,310

[45] Date of Patent: Feb. 15, 1994

[54] LOW NICKEL, COPPER CONTAINING CHROMIUM-NICKEL-MANGANESE-COPPER-NITROGEN AUSTENITIC STAINLESS STEEL

[75] Inventors: Gary M. Carinci, New Kensington; Ivan A. Franson, Saxonburg; Dominic A. Sorace, Sarver; John P. Ziemianski, Avonmore, all of Pa.

[73] Assignee: Allegheny Ludlum Corporation, Pittsburgh, Pa.

[21] Appl. No.: 960,030

[22] Filed: Oct. 13, 1992

[51] Int. Cl.[5] ..... C22C 38/58

[52] U.S. Cl. ..... 148/327; 420/58

[58] Field of Search ..... 148/327; 420/58

[56] References Cited

U.S. PATENT DOCUMENTS

| | | | |
|---|---|---|---|
| 3,615,365 | 10/1971 | McCunn | 420/58 |
| 3,615,366 | 10/1971 | Allen | 420/58 |
| 4,533,391 | 8/1985 | Borneman et al. | 420/58 |
| 4,568,387 | 2/1986 | Ziemianski | 420/58 |

OTHER PUBLICATIONS

"Standard Procedure for Calibrating Magnetic Instruments to Measure the Delta Ferrite Content of Austenitic and Duplex Austenitic-Ferritic Stainless Steel Weld Metal", 1991, American Welding Society, Miami, Florida.

"Armco Nitronic 30 Stainless Steel Sheet and Strip", Product Data Bulletin No. S-1, 1990, Armco Inc.

*Primary Examiner*—Deborah Yee

*Attorney, Agent, or Firm*—Patrick J. Viccaro

[57] ABSTRACT

An low-nickel austenitic stainless alloy containing about 16.5 to about 17.5% by weight chromium; about 6.4 to about 8.0% by weight manganese; about 2.5 to about 5.0% by weight nickel; about 2.0 to less than about 3.0% by weight copper; less than about 0.15% by weight carbon; less than about 0.2% by weight nitrogen; less than about 1% by weight silicon; and the balance essentially iron with incidental impurities.

16 Claims, No Drawings

LOW NICKEL, COPPER CONTAINING CHROMIUM-NICKEL-MANGANESE-COPPER-NITROGEN AUSTENITIC STAINLESS STEEL

BACKGROUND OF THE INVENTION

1. Field of the Invention

The invention relates to an austenitic stainless steel, and in particular, relates to an austenitic stainless steel which has a low nickel content and desirable metallographic, mechanical and corrosion resistance properties.

2. Description of the Invention Background

Certain iron and chromium alloys are highly resistant to corrosion and oxidation at high temperatures and also maintain considerable strength at these temperatures. These alloys are known as the stainless steels. The three major groups of stainless steels are the austenitic steels, the ferritic steels and the martensitic steels. The austenitic stainless steels have a microstructure at room temperature substantially comprised of a single austenite phase. Because of their desirable properties, the austenitic steels have received greater acceptance than the ferritic and martensitic types.

Chromium promotes the formation of delta ferrite microstructure in the stainless steels. This is usually undesirable in austenitic stainless steels. For example, in most conventional size ingots, if more than 10% delta ferrite is present during hot rolling, the resultant product will have slivers, hot tears and be prone to cracking unless costly treatments and procedures are employed. Nickel is therefore added to the austenitic stainless steels because it prevents the formation of delta ferrite and stabilizes the austenite microstructure at room temperature. Favorable mechanical properties, enhanced formability and increased corrosion resistance in reducing environments result. At present, the most widely produced austenitic stainless steel is AISI type 304, having 8.00–12.00% nickel.

Nickel is not abundant and the demand for the element has steadily increased. As such, the cost of nickel is projected to escalate, causing the price of nickel-containing austenitic steels to rise and, perhaps, become non-competitive with other materials. Because of the probability of fluctuations in the price of nickel and its increasing scarcity, it has been an object of researchers to develop an alternative austenitic stainless steel alloy which contains relatively lesser amounts of nickel, but which has corrosion resistance and mechanical properties comparable to existing nickel-containing austenitic alloys.

Lowering the nickel content of an austenitic stainless alloy promotes delta ferrite formation and the austenite phase becomes unstable. Therefore, as the nickel content is lowered in an unstable austenitic steel, the austenite phase must be stabilized by the addition of other austenite-promoting, or "austenitizing", elements. These elements include, for example, carbon, nitrogen, manganese, copper and cobalt. None of these elements as a single addition is entirely satisfactory. Cobalt is only slightly effective as an austenitizer and is quite expensive. Addition of carbon in an amount necessary to form a completely austenitic microstructure detrimentally affects ductility and corrosion resistance. Nitrogen cannot be added in quantities sufficient to achieve the desired effect, while additions of both carbon and nitrogen, due to interstitial solid solution hardening, undesirably increase the strength of the alloy.

Manganese and copper are relatively weak austenitizers.

Although commercially available austenitic stainless steels exhibit predominantly the austenite phase in their asprocessed condition, certain austenitic alloy compositions become unstable by forming appreciable amounts of martensite when they are deformed during cold working. The amount of martensite formed during deformation is the most important cause of work hardening. An austenitic stainless steel may be considered "stable" if it forms less than about 10% martensite upon heavy cold deformation and "unstable" if it forms 10% or more martensite. The 10% limit is significant because deep drawing operations are less desirable above that percentage as cracking or excessive die wear tends to occur. The propensity of an austenitic steel to form martensite upon cold working may be reduced or eliminated by increasing the alloy content, especially the nickel content. However, as explained above, a high nickel content is economically undesirable. Manganese and copper, although relatively weak austenite stabilizers, have a beneficial side effect as they decrease the work hardening rate of austenitic steels by suppressing the transformation of austenite to martensite during plastic deformation. Thus, by alloying with austenite-promoting elements, a low-nickel austenitic stainless steel may be developed having a low delta ferrite content, acceptable corrosion resistance and mechanical properties, and satisfactory resistance to martensite formation upon plastic deformation.

A number of prior art stainless steels have some similarities to that of the instant application. Attention is directed to U.S. Pat. Nos. 4,568,387, 4,533,391 and 3,615,365. These prior art references neither disclose the alloy of the instant application nor suggest the combination of elements that imparts the instant alloy with its unique combination of properties.

An object of the present invention is therefore to provide a nickel-manganese-copper-nitrogen austenitic stainless steel alloy having a reduced nickel content and acceptable metallographic structure, mechanical properties, corrosion resistance and workability. More specifically, an object of the invention is to provide a nickel-manganese-copper-nitrogen austenitic stainless steel alloy which has the following properties:

a. nickel content less than about 5% by weight and preferably less than 4% by weight;
b. low delta ferrite content of hot rolled and cold rolled sheet product;
c. satisfactory workability;
d. acceptable mechanical properties, e.g., yield strength, tensile strength and tensile elongation;
e. acceptable corrosion and pitting resistance; and
f. satisfactory resistance to martensite formation upon deformation.

SUMMARY OF THE INVENTION

In accordance with the present invention, austenitic alloys having the above-indicated desirable properties can be obtained by preparing an alloy having the following broad composition: about 16.5 to about 17.5% by weight chromium; about 6.4 to about 8.0% by weight manganese; about 2.50 to about 5.0% by weight nickel; about 2.0 to less than about 3.0% by weight copper; less than about 0.15% by weight carbon; less than about 0.2% by weight nitrogen; less than about 1% by weight silicon; and the balance of the alloy essentially iron with incidental impurities.

More particularly, it has been found that a more desirable alloy results from modifying the above broad composition to include a narrower preferred content for several of the alloying elements. The alloy preferably includes about 17% by weight chromium. A preferred range for the nickel content is between about 2.8 and about 4.0% by weight. A preferred total content of nitrogen and carbon is less than about 3000 parts per million by weight. Also, it is preferred that the alloy contain less than about 0.5% silicon.

DETAILED DESCRIPTION OF THE INVENTION

In the alloy of the present invention, a composition balance is achieved to obtain a low work hardening rate for the desired phase balance and stability of the alloy upon cold working.

Chromium is an important element in enhancing corrosion resistance and chromium content should equal or exceed about 16.5%. As the chromium content increases, however, the element causes an imbalance of austenite and delta ferrite at high temperatures and impairs hot workability. Therefore, chromium content should not exceed about 17.5%.

Addition of nickel to stainless alloys improves corrosion resistance and enhances cold workability by stabilizing the austenite phase and inhibiting austenite-to-martensite transformation. Nickel content should equal or exceed about 2.5% and, preferably, should exceed 2.75%. Nickel is, however, relatively expensive and should be used no more than is necessary. The nickel content should be limited to about 5%.

Manganese is important in enhancing cold workability because the element stabilizes the austenite phase. Manganese inhibits austenite-to-martensite transformation and cold workability improves as manganese content increases. The manganese content should equal or exceed about 6.4% in order to produced desirable effects. However, manganese tends to stabilize delta ferrite at high temperatures and inhibits hot workability when the manganese content exceeds about 8%. Therefore, manganese content is limited to a maximum 8%.

Copper, an important element which stabilizes austenite and inhibits austenite-to-martensite phase transformation, must be balanced with chromium content. The copper content should equal or exceed about 2.0%. As copper content increases, however, hot workability sharply decreases. Therefore, copper content is limited to about 3.0% at maximum. Within this 2.0–3.0% range, higher copper amounts can be present at lower chromium levels, but less copper is used at higher chromium levels.

Carbon reduces corrosion resistance and in the present invention should be limited to a maximum content of about 0.15%. Nitrogen should also be limited because it increases the alloy strength due to solid solution hardening. Nitrogen content is therefore limited to a maximum of about 0.2%. Total carbon and nitrogen content should be less than about 0.30%. Although silicon is required for deoxidation in refining steels, silicon decreases cold workability when added in excessive amounts. Therefore, silicon content is limited to less than about 1% at maximum.

Previous investigation has shown that at least about 17% chromium is necessary to provide minimum levels of corrosion resistance in austenitic stainless alloys comparable with AISI type 304. Using a base alloy of iron and approximately 17% chromium, experimental heats having various levels of manganese, nickel, copper, nitrogen carbon and silicon were melted and then hot rolled. Heats of austenitic alloys having the nominal composition of AISI types 201, 304 and 430 were also prepared for comparison. Samples of the hot rolled bands were visually inspected and measurements made to determine the amount of delta ferrite versus austenite microstructure present. The hot rolled bands were then quenched, grit blasted, pickled, and cold rolled. Samples of the cold rolled bands were then annealed and the mechanical properties, corrosion resistance and microstructure of the samples were investigated.

EXAMPLE I

Heats 1 through 15 (Series A) were prepared by vacuum induction melting. The composition of the heats is shown in Table I. A comparison heat was prepared with the nominal composition of AISI type 201 with lower C and N: hereinafter called T-201L.

TABLE I

| | Composition of Series A Experimental Heats | | | | | | | |
|---|---|---|---|---|---|---|---|---|
| Heat | Cr | Mn | Ni | Cu | N | Si | C | C + N |
| 1 | 17.05 | 7.7 | 3.1 | 2.8 | 0.112 | 0.39 | 0.051 | 0.163 |
| 2 | 17.09 | 11.6 | 3.1 | 2.9 | 0.115 | 0.36 | 0.053 | 0.168 |
| 3 | 17.00 | 15.3 | 2.1 | 2.1 | 0.120 | 0.37 | 0.055 | 0.169 |
| 4 | 16.94 | 15.4 | 2.1 | 3.1 | 0.130 | 0.37 | 0.055 | 0.185 |
| 5 | 16.78 | 15.53 | 3.1 | 2.1 | 0.119 | 0.35 | 0.055 | 0.174 |
| 6 | 16.90 | 15.3 | 3.1 | 3.0 | 0.130 | 0.35 | 0.047 | 0.177 |
| 7 | 16.89 | 15.26 | 3.1 | 3.1 | 0.190 | 0.39 | 0.020 | 0.210 |
| 8 | 16.98 | 15.56 | 4.1 | 1.0 | 0.117 | 0.35 | 0.022 | 0.139 |
| 9 | 16.97 | 15.48 | 4.2 | 2.0 | 0.115 | 0.35 | 0.020 | 0.135 |
| 10* | 16.91 | 7.95 | 3.0 | 2.7 | 0.119 | 0.34 | 0.056 | 0.175 |
| 11 | 17.04 | 7.96 | 2.92 | 2.29 | 0.106 | 0.29 | 0.041 | 0.147 |
| 12 | 17.04 | 7.28 | 2.92 | 2.33 | 0.108 | 0.29 | 0.047 | 0.155 |
| 13 | 16.99 | 7.93 | 2.89 | 1.96 | 0.108 | 0.30 | 0.045 | 0.153 |
| 14 | 16.98 | 7.22 | 2.90 | 1.94 | 0.113 | 0.29 | 0.046 | 0.159 |
| 15 | 17.01 | 7.99 | 2.93 | 2.74 | 0.187 | 0.29 | 0.016 | 0.203 |
| T-201L | 16.54 | 6.60 | 3.7 | 0.41 | 0.159 | 0.29 | 0.013 | 0.172 |

*Heat 10 also included 0.0001% cerium and 0.0040% boron.

It is contemplated that other elements may be present in the alloy compositions in addition to those listed above, either in small amounts as incidental impurities or as elements purposefully added for some auxiliary purpose such as, for example, to impart some desired property to the finished metal. The alloy may contain, for example, residual levels of phosphorous, aluminum and sulfur. Accordingly, the examples described herein should not be regarded as unduly limiting the claims.

Seventeen pound ingots from the Series A heats were reheated to 2100° F. and hot rolled to a 0.120 inch band. Six-by-0.120 inch band samples of the hot rolled ingots were sight-inspected for hot rolling performance. The delta ferrite levels of the hot rolled samples were measured using a MAGNE-GAGE instrument, available from American Instrument Company, Silver Spring, Md. The MAGNE-GAGE instrument operates by a magnetic attraction technique. The ferrite number, or "FN" units, used to report delta ferrite content herein is an arbitrary, standardized value correlating to the ferrite content of an austenitic alloy. It is contemplated that alternative methods may be used to determine delta ferrite content. For example, X-ray diffraction, ferrite scope and metallographic measurements can be made. A number of devices for measuring delta ferrite content and information on ferrite number measurements are provided in "Standard Procedures for Calibrating Magnetic Instruments to Measure the Delta Ferrite Content of Austenitic and Duplex Austenitic-Ferritic Stainless Steel Weld Metal," published in 1991 by the American Welding Society, Miami, Fla., and hereby incorporated by reference.

Table II indicates the extent of edge checks and longitudinal cracking in the hot rolled samples, and the samples' delta ferrite content. Edge checks include edge and corner cracks and tears, and are hot working defects caused by poor ductility. Edge checks generally occur at the cold end of the hot working range.

Heats 1 through 9 were first prepared to determine the effect of manganese and copper on the stability of the austenite microstructure. These initial heats had a manganese content of 7.7–15.56% and a copper content of 1.0–3.0%. During the hot rolling of the ingots from heats 4, 6 and 7, the ingots split and could not be subsequently processed. The delta ferrite content of samples from heats 1 through 9 indicate that additions of manganese to the melt greater than 8% did not significantly affect the austenite stability of the alloys and, in fact, may have promoted formation of delta ferrite during reheating. For example, the hot rolled band from heat 1 (7.7% manganese) and heat 5 (15.53% manganese) contained approximately 3.5% and 5.35% ferrite, respectively. Because the only other difference between these two heats was copper content, which was 2.8% for heat 1 and 2.1% for heat 5, it is believed that the two-fold increase in manganese content actually increased delta ferrite content. It is also believed that addition of manganese suppresses the tendency for austenite-to-martensite transformation during plastic deformation. It is believed that a manganese content less than 6.5% would result in a martensite content upon deformation which would result in an unacceptably high work hardening rate. Accordingly, the manganese content in heats subsequent to heat 9 was reduced from approximately 16% to a range of from about 7.25% to about 8%.

Because ingots containing 3.0% copper at lower chromium contents of less than 17% (heats 4, 6 and 7) were prone to . splitting during hot rolling, in order to enhance hot rolling performance, and in conjunction with the reduction in manganese content, the copper content in heats 10 through 15 was reduced to the 2.0–2.75% range. To reduce the occurrence of hot cracking and edge checking during hot rolling, heat 10 was prepared with additions of boron and cerium. No edge checks or cracks were initiated during hot rolling of the ingot from heat 10. The carbon and nitrogen concentration of heats 10 through 15 was also varied.

TABLE II

Hot Rolling Performance of Series A Experimental Heats After 2100° F. Reheat

| Heat | Comments | FN |
|---|---|---|
| 1 | 0.125" edge checks | 3.5 |
| 2 | 0.5"–0.75" edge checks; longitudinal cracks | 6.13 |
| 3 | 0.5"–0.75" edge checks | 7.95 |
| 4 | ingot split during spreading | 9.0 |
| 5 | 0.25" edge checks | 5.35 |
| 6 | ingot split during spreading | 7.3 |
| 7 | ingot split during spreading | 6.0 |
| 8 | 0.125" edge checks | 5.65 |
| 9 | 0.5" edge checks | 6.7 |
| 10 | no edge checks | 3.5 |
| 11 | 0.25" edge checks | 3.5 |
| 12 | 0.125" edge checks | 2.8 |
| 13 | 0.063" edge checks | 3.8 |
| 14 | 0.125" edge checks | 2.8 |
| 15 | 0.25–0.5" edge checks | 1.5 |
| T-201L | no edge checks | 1.7 |

The results of Table II show that experimental heats exhibited fewer or no edge checks at relatively low delta ferrite levels characterized by a ferrite number of 10 or lower. Preferably, FN is 7 or lower, and more preferably FN is 4 or lower.

After hot rolling, bands from the Series A heats were grit blasted, pickled and cold rolled to a thickness of 0.060. Individual samples of the cold rolled sheet from each heat were then annealed at either 1950° F. for five minutes or 1950° F. for seven minutes. Mechanical properties, including yield strength, tensile strength and tensile elongation were evaluated for the annealed band samples. The results are shown in Tables III and IV. (Conversion is 1 ksi=6.89 MPa).

TABLE III

Mechanical Properties (Longitudinal) of Series A Experimental Material Annealed at 1950° F. for 5 Minutes (Time-at-Temperature)

| Heat | Yield Strength (ksi) | Tensile Strength (ksi) | Elongation (%) |
|---|---|---|---|
| 1 | 67.9 | 98.5 | 39 |
| 2 | 75.6 | 98.9 | 34 |
| 3 | 74.4 | 103.4 | 35 |
| 5 | 73.8 | 97.7 | 37 |
| 8 | 68.6 | 97.2 | 39 |
| 9 | 67.4 | 94.3 | 36 |
| 11 | 40.8 | 95.1 | 52 |
| 12 | 41.3 | 94.5 | 53.5 |
| 13 | 41.3 | 98.1 | 55 |
| 14 | 40.5 | 99.4 | 57.5 |
| 15 | 46.4 | 95.4 | 49 |
| T-201L | 45.3 | 118.1 | 54 |

TABLE IV

Mechanical Properties (Longitudinal) of Series A Experimental Material Annealed at 1950° F. for 7 Minutes (Time-at-Temperature)

| Heat | Yield Strength (ksi) | Tensile Strength (ksi) | Elongation (%) |
|---|---|---|---|
| 1 | 39.4 | 93.3 | 44 |
| 2 | 39.6 | 92.8 | 39.5 |
| 3 | 47.9 | 98.6 | 40.5 |
| 5 | 41.3 | 93.5 | 42.5 |
| 8 | 41.4 | 93.4 | 44 |
| 9 | 39.5 | 92.4 | 40 |
| 10 | 37.7 | 92.9 | 52.5 |
| 11 | 42.0 | 94.6 | 52.0 |
| 12 | 41.9 | 95.5 | 54.5 |
| 13 | 42.6 | 98.3 | 54.0 |
| 14 | 41.9 | 99.9 | 56.5 |
| 15 | 47.6 | 96.7 | 50.0 |
| T-201L | 44.4 | 117.8 | 53.5 |

It is desirable that mechanical properties fall within a certain range. Yield strengths between about 35 ksi and about 50 ksi are preferred. A tensile strength between about 80 ksi and about 100 ksi is preferred. Tensile elongation between about 40% and about 60% is preferred.

As shown in Table IV, all of the samples annealed at 1950° F. for seven minutes exhibited preferred levels of yield strength, tensile strength and tensile elongation. As shown in Table III, when those same heats were annealed for five minutes at 1950° F., all the samples except heat 3 met the preferred tensile strength objectives. Samples from heats 1–9 fell outside the preferred yield strength and elongation ranges. In comparison, annealed heats of T-201L fell within the preferred yield strength and elongation ranges, but did not fall within the preferred tensile strength range. Thus, heats 10–14 all fell within preferred mechanical properties ranges. Heat 15, which had the highest nitrogen content of the heats, had slightly less than the preferred minimum 50% elongation when annealed at 1950° F. for five minutes.

The delta ferrite content of annealed Series A samples (Table V), measured by a MAGNE-GAGE instrument, indicates that in some cases the delta ferrite level slightly increased with increasing annealing time and temperature. This was the case with respect to all Series B experimental alloys, described below. It is believed that the increase in delta ferrite content with increasing annealing time and temperature is related to the low nickel content of the alloys and the resulting relatively weak stability of austenite with respect to delta ferrite. As shown in Table V, all samples continued to have acceptable delta ferrite levels (as FN values).

TABLE VII

Effect of Annealing Time at Temperature on Delta Ferrite Content (Shown as FN Values) of Series A Material Cold Rolled From 0.120" to 0.060"

| Heat | 1950° F. 5 min. | 1950° F. 7 min. | 1950° F. 10 min. | 2050° F. 5 min. | 2050° F. 7 min. | 2050° F. 10 min. |
|---|---|---|---|---|---|---|
| 1 | 2.3 | 1.3 | 1.3 | 1.3 | 1.3 | 1.3 |
| 2 | 2.7 | 1.5 | 1.5 | 1.5 | 1.5 | 1.5 |
| 3 | 7.5 | 6.1 | 6.6 | 7.2 | 7.0 | 7.1 |
| 5 | 2.5 | 2.0 | 1.8 | 2.0 | 2.0 | 2.0 |
| 8 | 3.3 | 2.1 | 2.1 | 2.6 | 2.1 | 2.1 |
| 9 | 4.0 | 2.6 | 2.7 | 3.1 | 2.7 | 2.7 |
| 10 | 2.5 | 2.7 | 2.5 | 2.5 | 2.5 | 2.5 |
| 11 | 1.9 | 1.9 | 2.1 | 2.5 | 2.3 | 2.6 |
| 12 | 1.9 | 1.9 | 2.0 | 2.4 | 2.1 | 2.6 |
| 13 | 2.0 | 1.9 | 2.0 | 2.5 | 2.3 | 2.7 |
| 14 | 1.9 | 1.8 | 1.8 | 2.3 | 2.0 | 2.6 |
| 15 | 1.7 | 1.7 | 1.8 | 2.3 | 2.2 | 2.4 |
| T-201L | 2.0 | 1.9 | 2.4 | 2.5 | 2.1 | 2.9 |

The corrosion and pitting resistance of the Series A experimental alloys was also investigated. Although some of the experimental alloys may have a reduced resistance to corrosion or pitting compared to other experimental alloys or to one or more commercially produced austenitic steels, the experimental alloys, though unsuited for certain applications, nonetheless would find service in other applications. Indeed, in light of their reduced cost (due to reduced nickel content), certain experimental alloys may be desirable over higher cost, more corrosion-resistant alloys.

To determine the corrosion resistance of the Series A experimental alloys, anodic polarization studies and ASTM A262, Practice E tests, were conducted on annealed samples. The anodic polarization test is carried out in an extreme environment and determines the alloy's critical current density ($I_c$), which is the maximum dissolution or corrosion rate prior to passivation. Passivation of a metal surface, in turn, is the point at which the alloy loses its normal chemical activity in an electrochemical system or a strong corrosive environment, and when oxygen is evolved upon the metal surface forming an oxide coating during electrolysis. In the anodic polarization studies, the sample was placed in a 1 Normal sulfuric acid solution and the critical current density was measured. All experimental samples, as well as T-201L, T-304 and T-430 were tested. A low critical current density ($I_c$), such as 0.21 mA/cm$^2$ for the T-304 sample, indicates a relatively low corrosion rate for the alloy in a 1 Normal sulfuric acid solution. In comparison, the critical current densities for T-201L (0.94 mA/cm$^2$) and T-430 (3.6 mA/cm$^2$) indicate that T-201L is less resistant to corrosion in a 1 Normal sulfuric acid solution than T-304, but is more resistant than T-430. As shown in Table VI, the critical current densities for the Series A experimental alloys ranged from 0.18 to 0.92 mA/cm$^2$. Therefore, annealed samples from several of the experimental heats exhibited corrosion resistance equal to or better than that for T-304, while all experimental alloys bettered the corrosion resistance of T-430. As such, all experimental alloys had acceptable corrosion resistance in 1 Normal sulfuric acid solution.

TABLE VI

Corrosion Test Results for Series A Experimental Alloys and T-304 and T-430

| Heat | 1 N $H_2SO_4$ $I_c$ (mA/cm$^2$) | 1000 ppm $Cl^-$ $E_p$ (Volts vs. SCE) | ASTM A262 Practice E |
|---|---|---|---|
| 1 | 0.18 | 0.32 | no cracking |
| 2 | 0.18 | 0.32 | no cracking |
| 3 | 0.92 | 0.11 | no cracking |
| 5 | 0.20 | 0.24 | no cracking |
| 8 | 0.63 | 0.22 | no cracking |
| 9 | 0.26 | 0.20 | no cracking |
| 10 | 0.30 | 0.28 | no cracking |
| 11 | 0.50 | 0.16 | no cracking |
| 12 | 0.34 | 0.24 | no cracking |
| 13 | 0.48 | 0.24 | no cracking |
| 14 | 0.37 | 0.34 | no cracking |
| 15 | 0.54 | 0.18 | no cracking |
| T-201L | 0.94 | 0.22 | no cracking |
| T-304 | ~0.21 | ~0.50 | no cracking |
| T-430 | ~3.6 | ~0.28 | no cracking |

To determine the pitting resistance of each of the Series A experimental alloys, anodic polarization was used to determine the pitting potential ($E_p$) of annealed samples in a 1,000 ppm chloride solution. A high pitting potential is indicative of an alloy which forms a tenacious, passive film promoting pitting resistance in chloride-containing environments. The results from these pitting potential studies (Table VI) show that T-304 has the highest pitting potential (0.50 V), while that of T-430 (0.28 V) is slightly higher than that for T-201L (0.22 V). In comparison, the Series A experimental alloys possess pitting potentials ranging from 0.11 V (heat 3) to 0.34 V (heat 14). Therefore, several of the experimental alloys had pitting potentials similar to that of T-201L, while several other alloys, for example alloys from heats 1, 2 and 10, had an even higher pitting potential similar to that of T-430. None of the experimental alloys were so lacking in pitting resistance as to be without utility.

To evaluate the experimental alloys' resistance to intergranular attack, the Copper-Copper Sulphate-Sulfuric Acid test (ASTM A262-70, Practice E) was conducted on annealed samples. After exposure to the boiling test solution for twenty-four hours, duplicate samples from each heat were bent through 180° and the outside surfaces were examined for accentuated intergranular penetrations. As reported in Table VI, none of the experimental samples or the samples of T-201L, T-304 and T-430 showed signs of either cracking or intergranular attack.

In order to determine the amount of martensite formed, and the austenite-stabilizing effect of manganese, nickel and carbon during deformation of the experimental alloys, MAGNE-GAGE measurements were made in the uniform elongation section on tensile samples before and after tensile strength testing. It is believed that any increase in the MAGNE-GAGE readings may be attributed to the formation of martensite during elongation. The results for selected samples from Series A are provided in Table VII. The cold rolled samples had been annealed as indicated before the tensile strength test was carried out. All tested experimental samples exhibited acceptable propensities to form martensite upon deformation. In contrast, T-201L formed relatively large amounts of martensite.

TABLE VII

Average Magne-Gage Reading (FN) Taken Before and After Mechanical Testing. (All Readings Taken Within the Uniform Elongation Section of the Tensile Test Sample)

| | 1950° F. for 5 min. | | 1950° F. for 7 min. | | 2050° F. for 7 min. | |
|---|---|---|---|---|---|---|
| Heat | Before | After | Before | After | Before | After |
| 10 | | | 2.7 | 3.0 | | |
| 11 | 1.9 | 2.8 | 1.9 | 2.6 | 2.3 | 3.0 |
| 12 | 1.9 | 3.2 | 1.9 | 3.9 | 2.1 | 4.3 |
| 13 | 2.0 | 6.1 | 1.9 | 4.9 | 2.3 | 5.7 |
| 14 | 1.9 | 9.2 | 1.8 | 8.9 | 2.0 | 13.1 |
| 15 | 1.7 | 2.0 | 1.7 | 2.3 | 2.2 | 2.4 |
| T-201L | 2.0 | 45.4 | 1.9 | 50.0 | 2.1 | 46.7 |

EXAMPLE 2

In an attempt to reduce delta ferrite levels while maintaining a 2350° F. reheat temperature, heats 17 through 22 were prepared having the compositions listed in Table VIII.

TABLE VIII

Composition of Series B Experimental Heats

| Heat | Cr | Mn | Ni | Cu | N | Si | C | C + N |
|---|---|---|---|---|---|---|---|---|
| 17 | 16.98 | 6.84 | 2.87 | 2.49 | 0.109 | 0.34 | 0.052 | 0.161 |
| 18 | 17.05 | 6.97 | 2.87 | 2.48 | 0.108 | 0.32 | 0.071 | 0.179 |
| 19 | 17.11 | 6.95 | 2.85 | 2.44 | 0.108 | 0.30 | 0.084 | 0.192 |
| 20 | 17.06 | 6.47 | 2.86 | 2.48 | 0.109 | 0.31 | 0.084 | 0.193 |
| 21 | 17.07 | 6.42 | 2.84 | 2.43 | 0.110 | 0.31 | 0.069 | 0.179 |
| 22 | 17.13 | 6.43 | 2.86 | 2.47 | 0.111 | 0.30 | 0.052 | 0.163 |

As suggested during testing of the Series A heats, manganese content in the Series B heats was limited to between about 6.4 to about 7.0% and copper content was limited to about 2.5%. Seventeen pound ingots from heats 17 through 22 were hot rolled from a reheat temperature of either 2100° F., 2250° F. or 2350° F., and denoted as (a), (b) and (c), respectively. The hot rolling performance and delta ferrite content of the Series B heats, determined using the method used with the Series A heats, are shown in Table IX.

TABLE IX

Hot Rolling Performance of Series B Experimental Heats After Reheating at Temperatures Indicated

| Heat | Hot Rolling Temperature | Comments | FN |
|---|---|---|---|
| 17 (a) | 2100° F. | 0.125" edge checks | 2.6 |
| 17 (b) | 2250° F. | no edge checks | 3.9 |
| 17 (c) | 2350° F. | 0.25" edge checks | 9.05 |
| 18 (a) | 2100° F. | no edge checks | 2.28 |
| 18 (b) | 2250° F. | no edge checks | 3.3 |
| 18 (c) | 2350° F. | 0.125" edge checks | 6.8 |
| 19 (a) | 2100° F. | no edge checks | 1.45 |
| 19 (b) | 2250° F. | no edge checks | 2.43 |
| 19 (c) | 2350° F. | no edge checks | 5.35 |
| 20 (a) | 2100° F. | no edge checks | 2.08 |
| 20 (b) | 2250° F. | no edge checks | 2.33 |
| 20 (c) | 2350° F. | no edge checks | 5.15 |
| 21 (a) | 2100° F. | no edge checks | 2.28 |
| 21 (b) | 2250° F. | no edge checks | 3.9 |
| 21 (c) | 2350° F. | 0.125" edge checks | 6.75 |
| 22 (a) | 2100° F. | 0.125" edge checks | 4.75 |
| 22 (b) | 2250° F. | 0.125" edge checks | 4.65 |
| 22 (c) | 2350° F. | 0.125" edge checks | 8.98 |

Hot rolling performance and delta ferrite content were satisfactory for all of the Series B heats at all hot rolling temperatures. The amount of delta ferrite in the hot samples generally increased with increasing hot rolling temperature. Heats 19 and 20, which had the highest carbon levels (0.084%) of all Series A and B heats, were hot rolled without edge checks and contained the least amount of delta ferrite.

After hot rolling, the bands from the Series B heats were grit blasted, pickled and cold rolled to a 0.060 inch thickness. Cold rolled samples were then annealed at 1950° F. for seven minutes. The mechanical properties, including yield strength, tensile strength and elongation of the annealed samples, are A reported in Table X.

TABLE X

Mechanical Properties (Longitudinal) of Series B Experimental Material Annealed at 1950° F. for 7 Minutes (Time-at-Temperature)

| Heat | Yield Strength (ksi) | Tensile Strength (ksi) | Elongation (%) |
|---|---|---|---|
| 17 (a) | 39.6 | 92.2 | 56 |
| 17 (b) | 40.3 | 89.7 | 54 |
| 17 (c) | 39 | 88.4 | 53 |
| 18 (a) | 40.5 | 90.9 | 57 |
| 18 (b) | 39.8 | 87.9 | 54 |
| 18 (c) | 39.7 | 87.4 | 52 |
| 19 (a) | 38.9 | 93.3 | 59 |
| 19 (b) | 38.8 | 87.9 | 54 |
| 19 (c) | 39.5 | 87.8 | 55 |
| 20 (a) | 42.5 | 91.2 | 58 |
| 20 (b) | 40.7 | 88.4 | 55 |
| 20 (c) | 40.3 | 88 | 55 |
| 21 (a) | 42.1 | 93.1 | 58 |
| 21 (b) | 41.3 | 88.5 | 54 |
| 21 (c) | 39 | 89.3 | 55 |
| 22 (a) | 41.8 | 91.9 | 56 |
| 22 (b) | 40.3 | 88.4 | 55 |
| 22 (c) | 39.6 | 89.2 | 52 |

As shown in Table X, all of the Series B samples had mechanical properties which fell within the required range discussed above in connection with the Series A heats.

The effect of annealing on the delta ferrite content of Series B material cold rolled from 0.120 inches to 0.600 inches was also investigated. The results are provided in Table XI. The Series B samples were annealed at 1950° F. for seven minutes. The delta ferrite content values were acceptable for all experimental samples.

TABLE XI

Effect of Annealing at 1950° F. for 7 Minutes on Magne-Gage Readings of Series B Material Cold Rolled From 0.120" to 0.060"

| Heat | FN |
|---|---|
| 17 (a) | 1.9 |
| 17 (b) | 1.85 |
| 17 (c) | 2.4 |
| 18 (a) | 1.85 |
| 18 (b) | 1.75 |
| 18 (c) | 1.95 |
| 19 (a) | 1.75 |
| 19 (b) | 1.65 |
| 19 (c) | 1.75 |
| 20 (a) | 1.7 |
| 20 (b) | 1.7 |
| 20 (c) | 1.75 |
| 21 (a) | 1.75 |
| 21 (b) | 1.75 |
| 21 (c) | 2.0 |
| 22 (a) | 1.8 |
| 22 (b) | 1.85 |
| 22 (c) | 2.45 |

Using procedures identical to those used in connection with the Series A experimental samples, test were done to determine corrosion and pitting resistance, and resistance to intergranular attack for the Series B samples. As with the Series A samples, the results, shown in Table XII, indicate adequate resistance to corrosion, pitting and intergranular attack for all Series B samples.

TABLE XII

Corrosion Test Results for Series B Experimental Alloys and T-304, T-430, and T-201L

| Heat | 1 N $H_2SO_4$ $I_c$ (mA/cm$^2$) | 1000 ppm $Cl^-$ $E_p$ (Volts vs. SCE) | ASTM A262 Practice E |
|---|---|---|---|
| 17 (a) | 0.23 | 0.19 | no cracking |
| 17 (b) | 0.27 | 0.15 | no cracking |
| 17 (c) | 0.23 | 0.30 | no cracking |
| 18 (a) | 0.19 | 0.17 | no cracking |
| 18 (b) | 0.25 | 0.20 | no cracking |
| 18 (c) | 0.20 | 0.23 | no cracking |
| 19 (a) | 0.23 | 0.22 | no cracking |
| 19 (b) | 0.27 | 0.29 | no cracking |
| 19 (c) | 0.14 | 0.27 | no cracking |
| 20 (a) | 0.19 | 0.20 | no cracking |
| 20 (b) | 0.29 | 0.15 | no cracking |
| 20 (c) | 0.19 | 0.27 | no cracking |
| 21 (a) | 0.19 | 0.27 | no cracking |
| 21 (b) | 0.31 | 0.16 | no cracking |
| 21 (c) | 0.27 | 0.17 | no cracking |
| 22 (a) | 0.18 | 0.13 | no cracking |
| 22 (b) | 0.29 | 0.15 | no cracking |
| 22 (c) | 0.15 | 0.13 | no cracking |
| T-201L | 0.94 | 0.22 | no cracking |
| T-304 | ~0.21 | ~0.50 | no cracking |
| T-430 | ~3.6 | ~0.28 | no cracking |

Using the procedure utilized in connection with the Series A experimental heats, the propensity of annealed Series B samples to form martensite during deformation was evaluated. The results are provided in Table XIII below. The test was conducted on samples of the Series B heats which had been hot rolled at a 2100° F. reheat temperature. Tensile testing was performed in accordance with ASTM E8-91 using a strain rate of 0.005 in./in./min. to the 0.2% yield offset, and a crosshead speed of 0.5 in./min. was used after yield.

TABLE XIII

Average Magne-Gage Reading Taken Before and After Mechanical Testing. (All Readings Taken Within the Uniform Elongation Section of the Tensile Test Sample)

| | 1950° F. 5 min. | | 1950° F. 7 min. | |
|---|---|---|---|---|
| Heat | Before | After | Before | After |
| 17 (a) | 1.75 | 5.0 | 1.9 | 6.0 |
| 18 (a) | 1.70 | 2.5 | 1.85 | 3.25 |
| 19 (a) | 1.65 | 2.25 | 1.75 | 3.0 |
| 20 (a) | 1.65 | 3.0 | 1.70 | 3.5 |
| 21 (a) | 1.65 | 4.0 | 1.75 | 6.0 |
| 22 (a) | 1.80 | 6.50 | 1.8 | 7.25 |

As shown in Table XIII, samples of heats 20 and 21 had favorable delta ferrite levels. To facilitate further testing of heats 20 and 21, replicas of these alloy compositions, heats 20' and 21' respectively, were prepared with the compositions shown in Table XIV.

TABLE XIV

| | Composition of Heats 20' and 21'. | | | | | | | |
|---|---|---|---|---|---|---|---|---|
| Heat | Cr | Mn | Ni | Cu | N | Si | C | C + N |
| 20' | 16.97 | 6.47 | 2.88 | 2.40 | 0.109 | 0.33 | 0.068 | 0.177 |
| 21' | 16.99 | 6.46 | 2.91 | 2.37 | 0.108 | 0.31 | 0.081 | 0.189 |

The material from heats 20' and 21' was processed to a 0.020 inch gauge and evaluated for formability. In evaluating formability, small, flat-bottom cups were deep drawn from the 0.020 inch material. Blanks with increasingly larger diameters were drawn into cylindrical, flat-bottomed cups to determine the maximum blank size which could be drawn successfully without fracturing. A limiting draw ratio (LDR), equal to the maximum blank diameter divided by the punch diameter, was calculated. The LDR for heats 20' and 21' was 2.12, which is comparable, to that of T-304 (2.18–2.25). The high LDR's of heats 20' and 21' indicate that these alloys have excellent drawability.

Remnant samples from heats 1 and 10 were also cold rolled to 0.020 inch, annealed, and formed into flat bottom cups. The amount of martensite formed during deep drawing was approximately 50% less as measured by MAGNE-GAGE from alloy samples of heats 20' and 21'. It is believed that the higher manganese content of heats 1 and 10 (approximately 8% manganese) as compared to heats 20' and 21' (6.5% manganese) provided additional austenite stability and resulted in less martensite formation during cold working.

To quantitatively characterize the effect of the various tested element combinations in Series A and B on austenite stability, conventional stepwise regression analyses were conducted. An initial analysis was conducted with delta ferrite content as the dependent variable and elemental composition of the alloy as the independent variables. Therefore, the analyses determined the delta ferrite content of the alloy as a function of the elemental composition of the alloy. The delta ferrite content of Series A and B hot band samples rolled at a 2100° F. reheat temperature (Tables II and IX) were relied upon. Elemental variables used were manganese, nickel, copper, carbon and nitrogen content. The twenty-one alloy compositions considered, listed in Table I and VIII, includes steels containing approximately 17% chromium and approximately 0.35% silicon with the following compositional ranges (in weight percentages): 6.4–15.5% manganese; 0.106–0.187% nitrogen; 0.013–0.084% carbon; 2.1–4.2% nickel; and 0.41–3.1% copper. T-201L was not included in the regression analysis because the chromium content of that heat varied significantly from that of other heats. Also, chromium and silicon content were not considered as they were held constant at about 17% and about 0.35%, respectively. The regression analyses accounted for both linear and squared main effect terms, while interaction terms were not included.

Analysis of data generated by the above-described experiments shows that a maximum coefficient of determination is achieved by the following six-variable model (Equation 1):

$$\%\ \text{Ferrite} = 12.48 + 0.52\ (\%\ \text{manganese}) - 54.27\ (\%\ \text{nitrogen}) - 47.98\ (\%\ \text{carbon}) - 1.57\ (\%\ \text{nickel}) - 1.62\ (\%\ \text{copper}) + 0.69\ (\%\ \text{copper})^2$$

The $R^2$ and three sigma limit for the above equation are, respectively, 0.93 and 1.4%. The delta ferrite forming potential, as calculated by the above equation, is less than 9%.

As expected, Equation 1 shows that nickel is an austenite-stabilizing element and that both nitrogen and carbon are also austenite-stabilizing elements having approximately 30 times the austenitizing power of nickel. Surprisingly, the above equation also indicates that at the 6.4%–15.5% levels used in the experimental alloys, manganese acts to stabilize delta ferrite even though manganese is normally an austenitizing element. In the alloy of the present invention, manganese affects austenite/ferrite balance and austenite/martensite balance.

A second regression study was conducted to formulate an equation describing the propensity of the alloys to form martensite during deformation as a function of carbon, copper and manganese content. A model was computed using the method used to formulate Equation 1. MAGNE-GAGE data from Tables VII and XIII relating to material from heats 13–15 and 17(*a*)–22(*a*) (hot rolled from a 2100° F. reheat temperature and annealed at 1950° F. for five minutes) was included in the regression analysis. It was assumed that an increase of 1 FN was caused by the formation of 1% martensite. This is generally the case for FN less than about 7. In the analyses of the data and the compositional components of this study, the maximum $R^2$ improvement for the dependent variable (% martensite formed on mechanical deformation) was established using the 3-variable model shown below (Equation 2):

$$\%\ \text{Martensite Formed} = 52.18 - 88.4\ (\%\ \text{carbon}) - 8.33\ (\%\ \text{copper}) - 3.52\ (\%\ \text{manganese})$$

The $R^2$ and three sigma limit for equation 2 are, respectively, 0.88 and 2.4%. The martensite-forming potential is less than 8.6%. Equation 2 shows carbon to be nearly ten times more . effective than copper and also shows copper to be 2.4 times more effective than manganese in suppressing martensite formation. Thus, Equation 2 shows copper to be very effective in lowering the rate of work hardening by suppressing the transformation of austenite to martensite upon deformation.

The above data shows that low-nickel austenitic alloys having an elemental composition within the tested range have acceptable mechanical properties, metallographic structure, phase stability and corrosion resistance. The above data suggests that a preferred embodiment for the iron-based alloy invention would have the following nominal composition: about 17% chromium; about 7.5 to about 8% manganese; about 3.0% nickel; about 2.5% copper; about 0.07% carbon; about 0.11% nitrogen; and about 0.35% silicon.

It is understood that various other modifications of the invention described herein and new application of that invention will be apparent to those of ordinary skill in the art. For example, and not intended as limiting the appended claims, it will be apparent that the addition of other components to the alloy compositions claimed herein will provide advantageous properties to the resultant alloy. Accordingly, it is desired that in construing the appended claims they will not be limited to the specific examples of the claimed invention described herein.

What is claimed:

1. An austenitic stainless steel comprising the following elemental composition, on a weight percent basis:
about 16.5 to about 17.5% chromium;
about 6.4 to about 8.0% manganese;
about 2.50 to about 5.0% nickel;
about 2.0 to less than about 3.0% copper;
less than about 0.15% carbon;
less than about 0.2% nitrogen;
less than about 1% silicon;
the balance essentially iron and incidental impurities, the steel having delta ferrite less than about 9% according to the formula:

$$\%\ \text{delta ferrite} = 12.48 + 0.52\ (\%\ \text{manganese}) - 54.27\ (\%\ \text{nitrogen}) - 47.48\ (\%\ \text{carbon}) - 1.57\ (\%\ \text{nickel}) - 1.62\ (\%\ \text{copper}) + 0.69\ (\%\ \text{copper})^2.$$

2. The austenitic stainless steel of claim 1 having about 17% by weight chromium.

3. The austenitic stainless steel of claim 1 having about 2.8 to about 4.0% nickel.

4. The austenitic stainless steel of claim 1 having a total content of nitrogen and carbon less than about 0.30% by weight.

5. The austenitic stainless steel of claim 1 having less than about 0.5% silicon.

6. The austenitic stainless steel of claim 1 wherein said steel has a tensile strength between about 80 and about 100 ksi.

7. The austenitic stainless steel of claim 1 wherein the steel has a yield strength less than about 50 ksi.

8. The austenitic stainless steel of claim 7 wherein the steel has a yield strength between about 35 and less than about 50 ksi.

9. The austenitic stainless steel of claim 1 wherein the steel has a tensile elongation between about 40 and about 60%.

10. The austenitic stainless steel of claim 1 wherein the steel has a martensite-forming characteristic less than about 8.6% according to the formula:

$$\%\ \text{martensite} = 52.18 - 88.4(\%\ \text{carbon}) - 8.33(\%\ \text{copper}) - 3.52(\%\ \text{manganese}).$$

11. A low-nickel austenitic stainless steel comprising the following elemental composition, on a weight percent basis:
about 16.5 to about 17.5% chromium;
about 72.5 to about 8% manganese;

about 2.75 to about 5% nickel;
about 2.0 to less than about 3% copper;
less than about 0.15% carbon;
less than about 0.2% nitrogen;
total carbon and nitrogen content not to exceed about 0.30%;
less than about 1% silicon; and
the balance essentially iron and incidental impurities, the steel having delta ferrite less than about 9% according to the formula:

$$\%\ \text{delta ferrite} = 12.48 + 0.52\ (\%\ \text{manganese}) - 54.27\ (\%\ \text{nitrogen}) - 47.98\ (\%\ \text{copper}) - 1.57\ (\%\ \text{nickel}) - 1.62\ (\%\ \text{copper}) + 0.69\ (\%\ \text{copper})^2.$$

12. The austenitic stainless steel of claim 11 having about 3 to about 4% nickel.

13. The austenitic stainless steel of claim 12 having less than about 0.5% silicon.

14. A low-nickel austenitic stainless steel article having a composition, by weight percent, comprising
about 16.5 to about 17.5% chromium;
about 6.4 to about 8.0% manganese;
about 2.50 to about 5.0% nickel;
about 2.0 to less than about 3.0% copper;
less than about 0.15% carbon;
less than about 0.2% nitrogen;
less than about 1% silicon;
the balance iron and incidental impurities, the steel having delta ferrite less than about 9% according to the formula:

$$\%\ \text{delta ferrite} = 12.48 + 0.52\ (\%\ \text{manganese}) - 54.27\ (\%\ \text{nitrogen}) - 47.98\ (\%\ \text{carbon}) - 1.57\ (\%\ \text{nickel}) - 1.62\ (\%\ \text{copper}) + 0.69\ (\%\ \text{copper})^2,$$

the article characterized by a lower work hardening rate than that of T-201L, corrosion resistance comparable to T-201L and AISI T-430, the mechanical properties comparable to AISI T-304.

15. The austenitic stainless steel of claim 1 as hot rolled sheet having said delta ferrite content.

16. The austenitic stainless steel of claim 1 as cold rolled sheet having said delta ferrite content.

* * * * *